United States Patent [19]

Lehman

[11] 4,016,854

[45] Apr. 12, 1977

[54] SPRING TYPE BOTTLE CAP PISTOL

[76] Inventor: James A. Lehman, 1312 - 12th Ave., San Diego, Calif. 92101

[22] Filed: Sept. 22, 1975

[21] Appl. No.: 615,567

[52] U.S. Cl. ..... 124/27; 273/106 B; 124/42; 124/37; 124/81

[51] Int. Cl.[2] ..... F41B 15/00

[58] Field of Search ..... 124/27, 42, 28, 29, 124/37, 47, 41 R, 36, 2; 273/101, 106 R

[56] References Cited

UNITED STATES PATENTS

| | | | |
|---|---|---|---|
| 325,042 | 8/1885 | Benjamin | 124/49 X |
| 1,240,987 | 9/1917 | Lefever | 124/27 |
| 2,182,369 | 12/1939 | Barron | 124/81 |
| 2,742,889 | 4/1956 | Clauss | 124/26 |
| 3,487,824 | 1/1970 | Profitt | 124/42 X |
| 3,515,114 | 6/1970 | Caronneau | 124/36 UX |
| 3,859,977 | 1/1975 | Lange | 124/27 X |

*Primary Examiner*—Richard C. Pinkham
*Assistant Examiner*—William R. Browne

[57] ABSTRACT

A pistol to propel and spin ring-like projectiles such as bottle caps. An impeller is released by a trigger and an off-center mounted hammer strikes and propels the bottle caps with a spin. As the bottle cap exits from the barrel of the gun, a wall mounted rib imparts an additional spinning force to the bottle cap. The trigger of the pistol has a portion for engaging and holding an inside surface of the peripheral wall of the projectile in the firing chamber. When the trigger is actuated the portion engaging the projectile will pivot away and permit the spring biased plunger to engage and propel the projectile.

9 Claims, 6 Drawing Figures

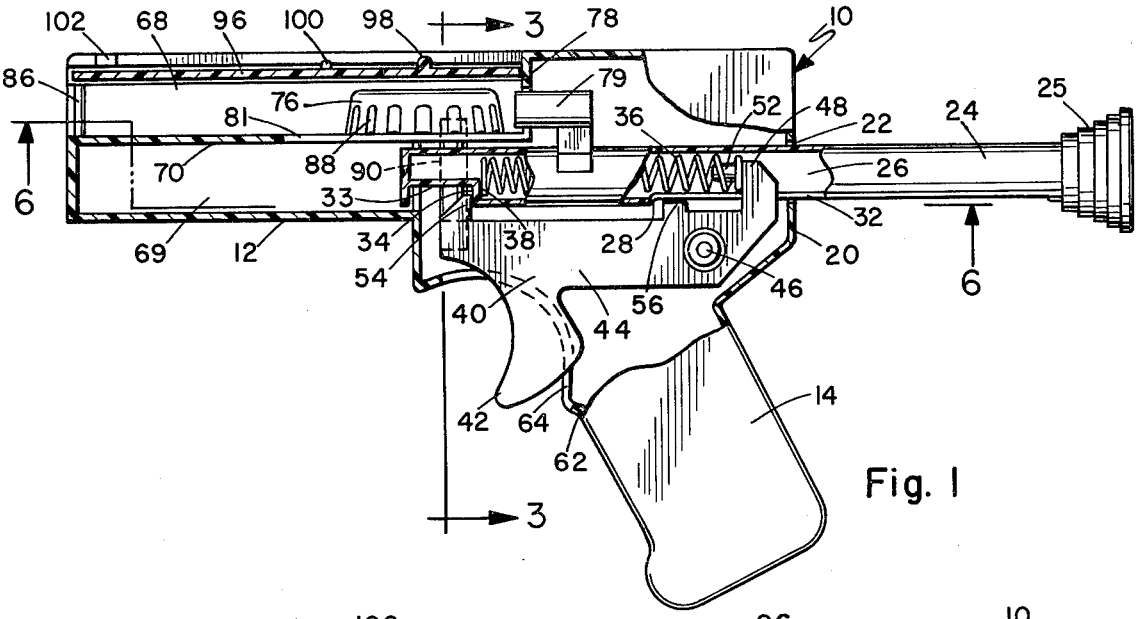
Fig. 1
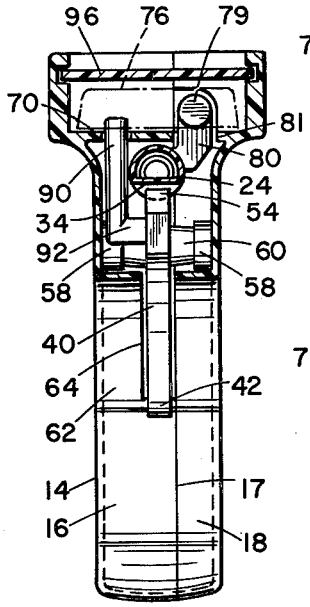
Fig. 3
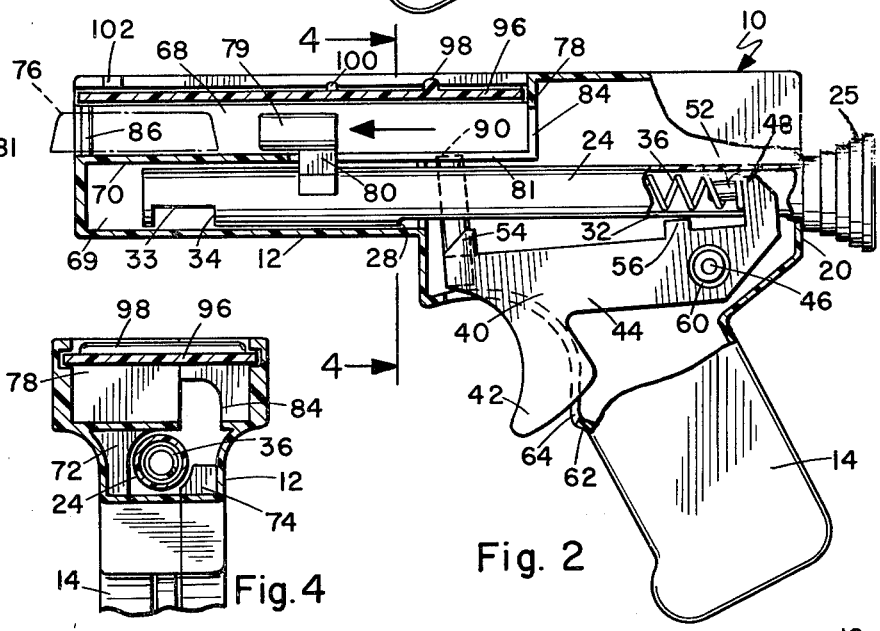
Fig. 2
Fig. 4
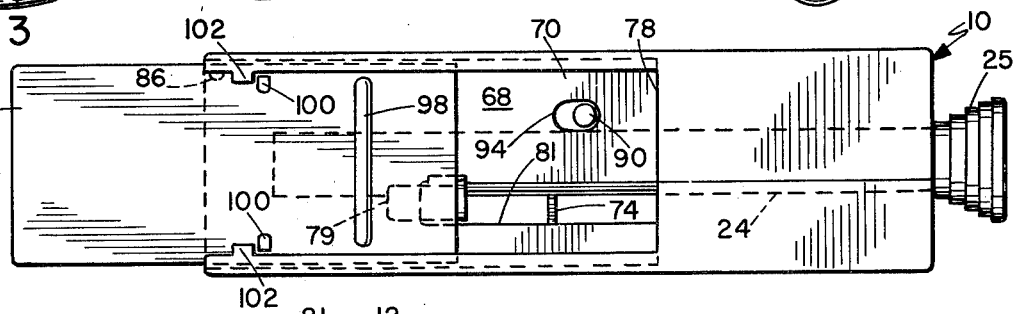
Fig. 5
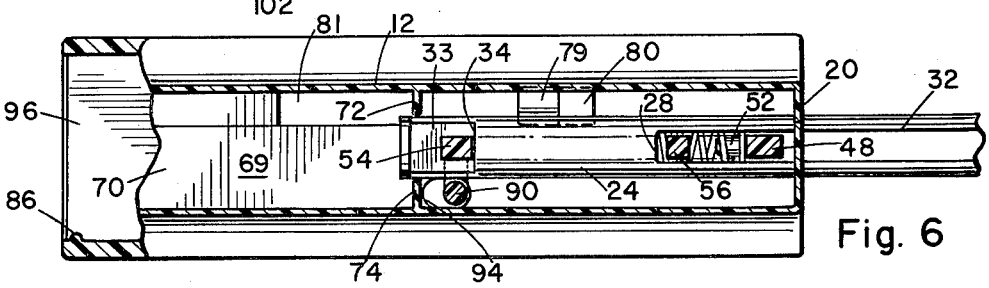
Fig. 6

SPRING TYPE BOTTLE CAP PISTOL

BACKGROUND OF THE INVENTION

For many years, children as well as adults, have amused themselves by propelling ring or disc shaped projectiles through the air. The spinning motion of the projectile causes it to travel with a "floating" motion. The projectiles have been generally circular or disc shaped rocks, wood chips and bottle caps. One of the limitations in the amusement afforded by such activities is that without a gun of some kind, the projectile can only be propelled as far as the individual can throw it. This indicates that the amusement afforded the participant is limited by the participant's strength. So it is desirable to provide a pistol type device that propels such projectiles with a reasonable degree of accuracy and predictable motion.

Several devices have been developed in the prior art to propel circular or ring-like projectiles. One such device is useful only with coins that are propelled from a pistol. The coin is loaded in a slot in the top of the firing chamber between a pair of springs that in the cocked position are held in tension. In a normal manner, a trigger releases an impeller that is violently thrust toward the exit of the firing chamber driving the coin in front of it. The major deficiency in this device is primarily its limitation for use with coins only, which are flat and dense and comparable to slugs.

Devices have been made to propel bottle caps. Bottle caps are generally a disposable product and no great expense is involved in their use. Also, they are less compact and of larger dimensions than coins and are not as easily lost. Furthermore, they "float" more and are more interesting to watch. One device in the prior art utilizes a generally rectangular barrel. The cap is inserted into the barrel and the user violently swings it to propel the bottle cap through the air. It takes a substantial force to cause the bottle cap to travel up the barrel and emerge therefrom. The most obvious deficiency of this device is that the magnitude of propulsion force that can be applied to the bottle cap is limited, and it is difficult to predict where the bottle cap will go once it has been launched. Also, many children would probably not be able to cause the bottle cap to emerge with any appreciable force from the barrel.

Another device designed to launch bottle caps utilizes an open firing chamber and an elastic sling-shot. The bottle cap is pushed against the firing chamber and held in place by the user. An elastic band is stretched over the bottle cap and the pistol is aimed in the direction desired. When it is desired to launch the bottle cap, the user lifts his finger from the bottle cap and the elastic band slings the bottle cap out of the pistol and toward the target. The primary deficiency in this device is that it is essentially an elastic sling-slot. The elastic bands are generally rubber bands and subject to overstretch and breaking. They often break prior to the bottle cap being launched and can snap back and injure the user. Furthermore, loading this device is a rather cumbersome procedure requiring the both of the user's hands and constant attention. Also, the user can inadvertently lift his finger permitting the bottle cap to be launched at undesired times. This can create a rather dangerous situation since the cap may be propelled in an unwanted direction and injure another person.

There has therefore been a need for a device that propels a bottle cap or other ring-like projectile imparting a spinning motion to the same, and that is durable, compact, easy to load, easy to use, and that prevents unintentional launching of the projectile.

SUMMARY OF THE INVENTION

In an exemplary embodiment of the invention, the pistol comprises a firing chamber connected to a handle with an impeller means movably mounted in the firing chamber. The impeller means comprises a plunger having a central cavity. Urging means in the form of a spring is loaded in the central bore of the plunger. A trigger is pivotally mounted in the handle and has a finger tab that is accessible externally thereof. The trigger comprises a sear that contacts a shoulder of the plunger to maintain the plunger in a cocked position. The trigger also comprises a restraining means in the form of a stop that contacts another shoulder of the plunger to prevent the plunger from being over-cocked. The trigger comprises an anvil received in a slot in the plunger and the anvil includes a plug inserted into one or more windings of the spring. The plunger has an end knob and is cocked by drawing the same outwardly. As the plunger is drawn outwardly, the spring is compressed to store the energy that is released during the firing stroke.

The firing chamber is partitioned into an upper barrel and a lower chamber. A projectile, such as a bottle cap, is placed in the barrel by sliding a cover that is movable on the stop of the barrel. After the bottle cap is loaded into the barrel, the cover is returned to its nominal position completely enclosing the bottle cap in the pistol.

An L-shaped hammer has a stem connected to the plunger. The connection to the plunger is off-center so that the hammer strikes the bottle cap off-center with an impelling blow that projects the bottle cap out of the barrel while concurrently causing the same to spin. A rib is formed on a wall of the barrel at the exit of the firing chamber. As the bottle cap exits from the firing chamber, the peripheral depressions contact the rib. This imparts an additional spinning motion force to the bottle cap so that it appears to float or hover.

The plunger is released by depressing the trigger. The trigger motion causes the sear to disengage from the plunger to free the same to fire. A pair of guide members are mounted in the lower chamber and prevent the plunger from wobbling during the firing stroke. Restraining means are associated with the trigger to restrain the bottle cap in the barrel until such time as the pistol is fired. The restraining means in an exemplary embodiment comprises an L-shaped pin having a stem connected to the trigger. The pin extends up through the lower chamber, through a hole in the partition and into the barrel abutting the internal wall of the bottle cap. When the trigger is depressed, the pin pivots out of the bottle cap and frees the same for its projection.

It is therefore an object of the invention to provide a new and improved pistol for propelling ring-like projectiles.

Another object of the invention is to provide a new and improved pistol for propelling bottle caps.

Another object is to provide a new and improved pistol for propelling ring-like projectiles that has new and improved aiming capabilies, is easily aimed, can be safely and conveniently carried in the cocked position, and can be fired in any position.

Another object of the invention is to provide a new and improved pistol for simultaneously propelling and spinning projectiles.

Another object of the invention is to provide a new and improved pistol for applying a spinning force to a projectile at the point of application of a propelling force.

Another object of the invention is to provide a new and improved pistol that applies an auxiliary spinning force to a projectile as it exits from the pistol.

Another object of the invention is to provide a new and improved pistol in which the projectiles are prevented from inadvertently falling out of the pistol until it is fired.

Another object of the invention is to provide a new and improved pistol in which the projectiles are top loaded by sliding a movable cover.

Another object of the invention is to provide a new and improved pistol for propelling projectiles in which the impeller is prevented from being over-cocked.

Another object of the invention is to provide a new and improved pistol for propelling projectiles that is durable, inexpensive and efficient in operation.

Other objects and many attendant advantages of the invention will become more apparent upon a reading of the following detailed description together with the drawings in which like reference numerals refer to like parts throughout and in which:

FIG. 1 is a side elevation view, with portions cut away, showing the gun loaded and cocked ready for firing.

FIG. 2 is a similar side elevation view of the gun in a fired position.

FIG. 3 is a sectional view taken on the line 3—3 of FIG. 1.

FIG. 4 is a sectional view taken on the line 4—4 of FIG. 2.

FIG. 5 is a top plan view of the gun with the sliding cover open for loading.

FIG. 6 is a sectional view taken on the line 6—6 of FIG. 1.

In a preferred embodiment of the invention, pistol 10 comprises a firing chamber 12 and a handle 14. The firing chamber 12 and the handle 14 are unitarily constructed from first and second shells 16 and 18. The shells 16 and 18 have an off-center dividing line 17 so that most of the various slots and holes to be hereinafter described can be fully formed in one or the other of the shells 16 and 18.

The pistol 10 has a backwall 20 having a hole 22 formed therein. A plunger 24 is movably received in hole 22 and is slidable within the firing chamber 12. The plunger 24 may be gripped by the knob 25 to cock the pistol for firing. The plunger 24 has a central bore 26. A shoulder 28 is formed at one end of slot 32 in the exterior wall of the plunger 24. A notch 33 in the forward end of the plunger defines another shoulder 34. A spring 36 is longitudinally assembled in bore 26. One end of the spring 36 abuts an interior shoulder 38 that is also defined by the notch 33.

A trigger 40 is mounted for pivotal motion in the pistol 10. The trigger 40 comprises a finger tab 42 that when depressed rotates the trigger 40 about the pivot 46. The trigger 40 includes a lever part 44 that is pivotally mounted about the pivot 46. The lever part 44 includes a vertically projecting anvil 48, which projects through slot 32 in the plunger 24. A plug 52 is connected to the anvil 48, and the adjacent spring 36 is partially wound over the plug 52. In the cocked position, the plunger 24 is partially withdrawn from the pistol 10 through hole 22. The spring 36 compresses thereby storing the energy necessary for the firing stroke. A sear 54 is integrally formed with the lever part 44. The sear 54 abuts the shoulder 34 of the plunger 24, maintaining the plunger 24 is the cocked position until such time as the pistol 10 is fired. A stop 56 is integral with the lever part 44 and projects upwardly therefrom. The stop 56 is engageable by the shoulder 28 of the plunger 24 to prevent the plunger 24 from being over-cocked. To fire the pistol 10, the trigger 40 is actuated by depressing the tab 42, which projects through slot 64 formed in front wall 62 of the shell 16. This causes the trigger 40 to rotate about the pivot 46. The shells 16 and 18 of the pistol 10 are provided with sockets 58 and pivot pins 60 are formed on the lever part 44 and are received in the sockets 58. As the trigger 40 pivots, the sear 54 disengages from the shoulder 34. The spring 36 expands and forces the plunger 24 forward to apply the impelling force.

The firing chamber 12 is divided into an upper generally rectangular barrel 68 and a lower chamber 69, by means of the horizontal partition 70. The projectile, in this embodiment the bottle cap 76, is enclosed in the barrel 68 adjacent a vertical backwall 78. A hammer 79 has a stem 80 connected to the plunger 24. The connection is off-center and the hammer 79 projects toward the cap 76 and extends through a hole 84 in the backwall 78. When the trigger 40 releases the plunger 24 permitting the same to move through its firing stroke, the hammer 79 strikes the bottle cap 76 propelling the same outwardly. Partition 70 has a longitudinal slot 81 in which the stem 80 slides. Since the impact of the hammer 79 on the bottle cap 76 is off-center, the bottle cap will spin as it projects forward. A rib 86 is formed on an interior wall of the barrel 68 directly adjacent the exit of pistol 10. As the cap 76 emerges from the pistol 10, the peripheral depressions 88 in the cap 76 contact the rib 86. This has the effect of transforming part of the translational motion of the cap 76 into an increased spinning motion thereof. It should be noted that the barrel 68 is wide enough for the cap 76 to pass easily by the rib 86 and will accommodate bottle caps of various sizes. However, by striking the cap with the hammer 79 offset to the side opposite rib 86, the cap is driven across the barrel into positive contact with the rib, so that spinning is ensured.

Guide members 72 and 74 are formed in the lower chamber 69 and may be unitarily constructed with respect to the shells 16 and 18. The guides 72 and 74 have concave surfaces contoured with a radius of curvature similar to that of the plunger 24. The clearance between the exterior walls of plunger 24 and the guides 72 and 74 is insufficient to permit the plunger 24 to wobble during the firing stroke. If for any reason the plunger 24 wanders from a true firing path, it contacts the guides 72 and 74 and is redirected thereby.

The pistol 10 is provided with restraining means to prevent a bottle cap 75 from being released or discharged from the barrel 68 except upon the depression of trigger 40. The restraining means comprises a pin 90 having an orthogonal stem 92 connected to the lever part 44 on tone face thereof. The pin projects through a slot 94 formed in the horizontal partition 70. The tip of pin 90 abuts the interior wall of the cap 76 preventing the same from passing through the barrel 68 until the trigger 40 is depressed.

The pistol 10 is loaded from the top rather than from the barrel 68 exit. A slidable cover 96 is forwardly movable to expose a loading zone for the cap 76. To facilitate sliding the cover 96, a transverse raised rib 98 is formed on the exposed face of the cover 96. Furthermore, to prevent the cover 96 from being completely removed from the pistol 10, detents 100 project upwardly from the cover 96. The detents 100 contact shoulders 102 formed on the shells 16 and 18 and prevent the cover 96 from being completely removed.

The pistol 10 that has been described imparts a translational motion and a spinning motion to the cap 76. The spinning motion is produced by the off-centered blow of the hammer 79, and the action of the rib 86 against the bottle cap. Therefore, as the bottle cap 76 emerges from the barrel 68, it has a substantial spinning motion.

Having described my invention, I now claim:

1. A pistol for propelling projectiles comprising:

a projectile having bottle cap shape defining an inverted cavity with an annular downwardly extending peripheral wall;

a firing chamber receiving said projectile;

a handle connected to said firing chamber;

impeller means movably connected to said firing chamber and operative between a cocked position and through a firing stroke for impacting a spin producing and propelling force on the projectile, at the point of impact with the projectile;

a trigger means operatively associated with said handle for releasing said impeller means to apply the spin producing and propelling force on the projectile; and restraining means operatively connected to said trigger means and adapted for engaging and holding an inside surface of said peripheral wall of the projectile in said firing chamber until said trigger means is moved, and said restraining means then disengaging from the projectile to release the same for firing.

2. The pistol of claim 1 wherein, said impeller means comprises a plunger movable in said firing chamber, and a hammer operatively connected to said plunger and adapted for delivering an off-center force to the projectile for propelling and spinning the same.

3. The pistol of claim 2 and further including:

urging means operatively connected to said plunger and operative when released for driving said plunger from said cocked position through said firing stroke.

4. The pistol of claim 2 wherein, said firing chamber comprises a generally rectangular barrel, and a movable cover means assembled to said firing chamber in the vicinity of said barrel and adapted to be moved to expose a loading zone of said barrel for loading projectiles therein.

5. The pistol of claim 4 wherein, said impeller means further comprises means in said barrel at the exit thereof, adapted for contacting edgewise the forward moving projectile to cause the same to spin.

6. The pistol of claim 1 wherein, said trigger means includes a stop means engagable with said impeller and active for preventing the same from over-cocking, and a sear engagable with said impeller means and active for restraining said impeller means in the cocked position until release by moving said trigger means.

7. A pistol for propelling projectiles comprising:

a projectile having bottle cap shape defining an inverted cavity with an annular downwardly extending peripheral wall;

a firing chamber receiving said projectile;

a handle connected to said firing chamber;

impeller means movably connected to said firing chamber and operative between a cocked position and through a firing stroke for imparting a propelling force on the projectile at the point of impact therewith;

compound spinning means operatively associated with said impeller means and active for imparting a spin to the projectile at the point of impact between said impeller means and the projectile, and active to apply a further spin producing force on the projectile as the same emerges from said firing chamber;

a trigger movably assembled to said handle means and operative for releasing said impeller means from said cocked position; and restraining means operatively connected to said trigger means and adapted for engaging and holding an inside surface of said peripheral wall of the projectile in said firing chamber until said trigger means is moved, and said restraining means then disengaging from the projectile to release the same for firing.

8. The pistol of claim 7 wherein:

said impeller means comprises a plunger movable in said firing chamber, and said compound spinning means comprises a hammer operatively connected to said plunger and adapted for delivering an off-center force to the projectile for propelling and spinning the same.

9. The pistol of claim 7 wherein:

said compound spinning means further comprises means assembled to said firing chamber at the exit thereof adapted for contacting edgewise the forward moving projectile to cause the same to spin.

* * * * *